US006945645B2

(12) United States Patent
Baron

(10) Patent No.: US 6,945,645 B2
(45) Date of Patent: Sep. 20, 2005

(54) METHOD AND APPARATUS FOR SCORING MEDIA

(75) Inventor: John M. Baron, Longmont, CO (US)

(73) Assignee: Hewlett-Packard Development Company, LP., Houston, TX (US)

( * ) Notice: Subject to any disclaimer, the term of this patent is extended or adjusted under 35 U.S.C. 154(b) by 91 days.

(21) Appl. No.: 10/139,911

(22) Filed: May 6, 2002

(65) Prior Publication Data

US 2003/0206211 A1 Nov. 6, 2003

(51) Int. Cl.[7] ..... B41J 11/66

(52) U.S. Cl. ..... 347/104; 400/621; 347/37; 346/24

(58) Field of Search ..... 347/2, 37, 104; 234/35–37; 400/621; 346/24; B41J 11/66, 11/68, 11/70

(56) References Cited

U.S. PATENT DOCUMENTS

| | | | | | |
|---|---|---|---|---|---|
| 3,951,252 | A | * | 4/1976 | Selke et al. | 400/621 |
| 4,604,632 | A | * | 8/1986 | Matsumoto | 400/621 |
| 4,767,227 | A | | 8/1988 | Mitsuishi et al. | |
| 5,005,994 | A | | 4/1991 | Yano | |
| 5,039,235 | A | | 8/1991 | Takeuchi et al. | |
| 5,089,971 | A | * | 2/1992 | Gerber | 400/621 |
| 5,213,423 | A | | 5/1993 | Mizuno | |
| 5,276,970 | A | | 1/1994 | Wilcox et al. | |
| 5,292,201 | A | | 3/1994 | Yano | |
| 5,296,872 | A | | 3/1994 | Caamano | |
| 5,363,123 | A | | 11/1994 | Petersen et al. | |
| 5,449,239 | A | | 9/1995 | Koshiishi et al. | |
| 5,518,327 | A | | 5/1996 | Kasai | |
| 5,540,508 | A | | 7/1996 | Asada et al. | |
| 5,881,624 | A | | 3/1999 | Brugue et al. | |
| 5,882,128 | A | | 3/1999 | Hinojosa | |
| 6,117,061 | A | | 9/2000 | Popat et al. | |
| 6,151,037 | A | * | 11/2000 | Kaufman et al. | 347/104 |
| 6,217,167 | B1 | * | 4/2001 | Wen et al. | 347/101 |
| 6,270,215 | B1 | * | 8/2001 | Miyasaka et al. | 347/104 |
| 6,491,361 | B1 | * | 12/2002 | Spann | 347/104 |
| 6,554,511 | B2 | * | 4/2003 | Kwasny et al. | 400/621 |
| 6,599,044 | B2 | * | 7/2003 | Paris | 400/621 |
| 6,616,360 | B2 | * | 9/2003 | Lehmkuhl | 400/621 |

OTHER PUBLICATIONS

Inventor Richard A. Kelley; Confirmation No. 3210; U.S. Appl. No. 10/286,210; filed Oct. 31, 2002; Title Media Incising Printer Application as filed (38 pgs.).

Inventor Richard A. Kelley; Confirmation No. 3210; U.S. Appl. No. 10/286,210; filed Oct. 31, 2002; Title Media Incising Printer Filing Receipt mailed Dec. 5, 2002 (2 pgs.).

Inventor Richard A. Kelley; Confirmation No. 3210; U.S. Appl. No. 10/286,210; filed Oct. 31, 2002; Title Media Incising Printer Updated Filing Receipt mailed Feb. 5, 2003 ( 2 pgs.).

(Continued)

*Primary Examiner*—Stephen D. Meier
*Assistant Examiner*—Julian D Huffman

(57) ABSTRACT

A method and apparatus for printing and scoring media in a printing system. In one embodiment a scoring pattern is based upon input by the user on a graphical user interface. The system typically incorporates a controller that drives a scoring printer having a scoring head with one or more pins or wires that impact the surface of media and weaken the media. By creating a predetermined pattern of impacts, the media is weakened along a region or line for subsequent separation.

29 Claims, 11 Drawing Sheets

OTHER PUBLICATIONS

Inventor Richard A. Kelley; Confirmation No. 3210; U.S. Appl. No. 10/286,210; filed Oct. 31, 2002; Title Media Incising Printer Office Action—Restriction mailed Dec. 17, 2003 (5 pgs.).

Inventor Richard A. Kelley; Confirmation No. 3210; U.S. Appl. No. 10/286,210; filed Oct. 31, 2002; Title Media Incising Printer Office Action—Noncompliance mailed Jan. 3, 2003 (2 pgs.).

Inventor Richard A. Kelley; Confirmation No. 3210; U.S. Appl. No. 10/286,210; Filed Oct.31, 2002; Title Media Incising Printer Transmittal Letter and Response/Amendment (Election) dated Jan. 16, 2003 (4 pgs.).

Inventor Richard A. Kelley; Confirmation No. 3210; U.S. Appl. No. 10/286,210; filed Oct. 31, 2002; Title Media Incising Printer Transmittal Letter and Declaration mailed Jan. 17, 2003 (2 pgs.).

Inventor Richard A. Kelley; Confirmation No. 3210; U.S. Appl. No. 10/286,210; filed Oct. 31, 2002; Title Media Incising Printer Office Action mailed Apr. 28, 2004 (14 pgs.).

Inventor Richard A. Kelley; Confirmation No. 3210; U.S. Appl. No. 10/286,210; filed Oct. 31, 2002; Title Media Incising Printer Transmittal Letter and Amendment and Reply under 37 CFR 1.111 mailed Jun. 1, 2004 (31 pgs.).

* cited by examiner

METHOD AND APPARATUS FOR SCORING MEDIA

RELATED APPLICATIONS (Not applicable)

STATEMENT REGARDING FEDERALLY SPONSORED RESEARCH OR DEVELOPMENT (Not applicable)

FIELD OF THE INVENTION

This invention relates to a printer system that prints on a media and additionally scores the media in a pattern chosen by the user.

BACKGROUND OF THE INVENTION

Printers have been equipped with cutting devices so that a printed media can be cut at the end of the printing operation without removing the media from the printer. A typical system involves passing a rotary or fixed cutting blade across the media after the printing operation has been completed. Examples of these systems are disclosed in U.S. Pat. Nos. 5,363,123, 5,881,624, 5,296,872, and 5,882,128. These systems are designed to cut along a straight line across the media after the printing operation. However, if a user wishes to cut a line that is curved or angular, or cut out a closed shape from the media, these systems are inadequate. The user must cut the media in a separate operation after removing the media. U.S. Pat. No. 6,117,061 discloses system for printing upon removable portions of a two-dimensional media sheet. The removable portions are removed after printing and folded into three-dimensional shapes. This system, however, requires that the media be first scored or perforated before it is inserted into the printer, so that the removable portions can be removed from the media after printing.

What the prior-art systems lack is a means integrated with the printer that allows complex shapes to be cut or scored into the media as part of the printing operation.

BRIEF SUMMARY OF THE INVENTION

An aspect of the present invention involves a computer based system and method for scoring media. The system in accordance with one exemplary embodiment comprises a central processing unit, a display, a user manipulatable input device, graphical user interface and a scoring printer. Another aspect of the invention involves a scoring head which may be mounted separately from a printhead, but in some instances may be on a same carriage as the printhead. Some embodiments provide scoring with a moving scoring head that allows scoring of the media such as paper during the printing operation.

DETAILED DESCRIPTION OF THE INVENTION

Figure 1:
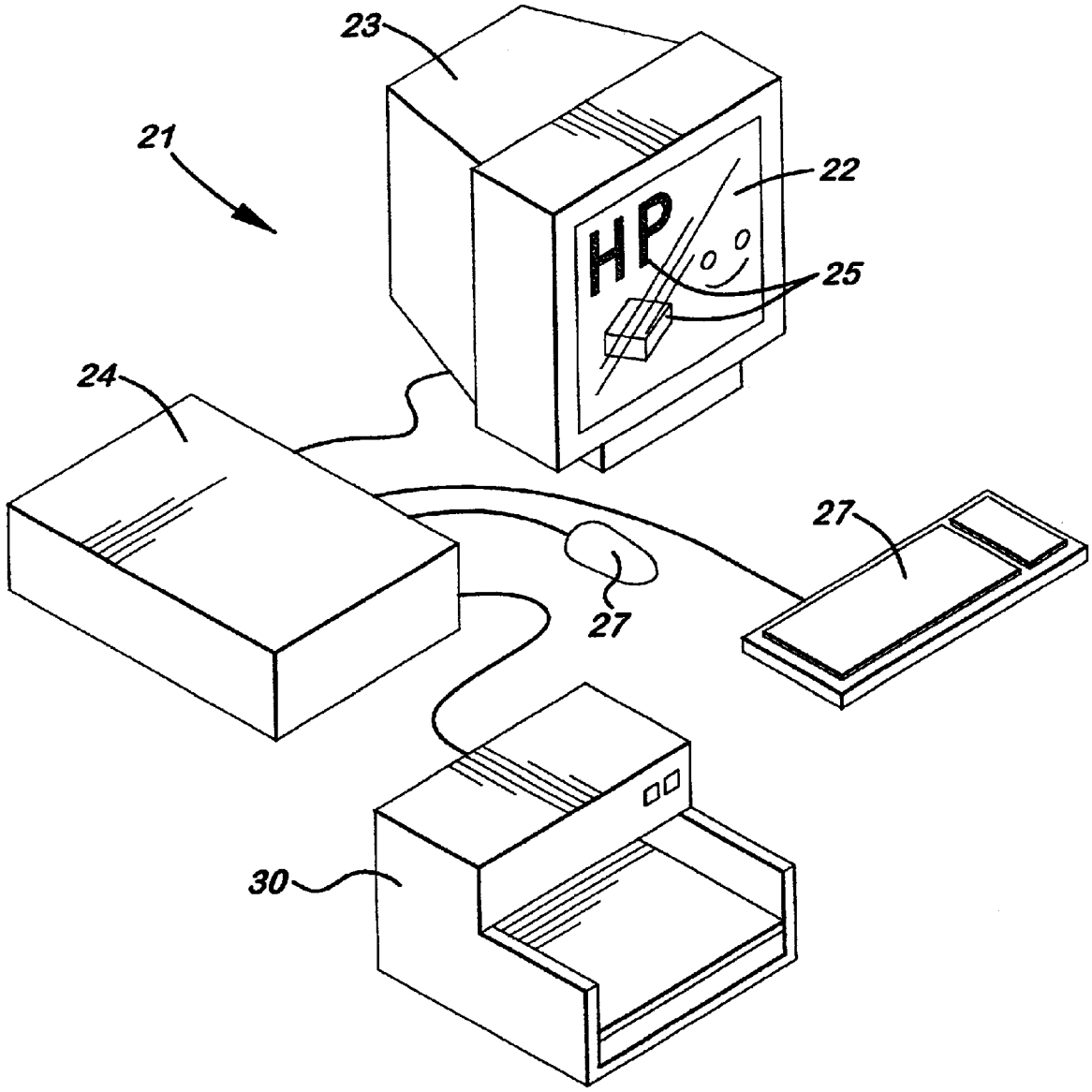
FIG. 1 is a schematic perspective view of a printing and scoring system according to an embodiment of the present invention.

Reference is now made to FIG. 1. Using a scoring system according to an embodiment of the present invention 21 a graphical representation 22 of a digital file or files, such as a document, is presented to appear upon a display or monitor 23 that is connected to a computer CPU 24. One or more input devices 27 can be used to edit the graphical representation 22 prior to generating a hardcopy output on a printer 30. The edited graphical representation 22 depicts elements and objects 25 of the file as they will appear after printing on a media, such as paper. The CPU 24 is typically a personal-type computer with a Graphical User Interface (GUI) operating system, such as, for example, any of the Microsoft Windows™ operating systems, UNIX, LINUX, Apple Macintosh OS™, and the like. The digital files are any suitable digital files that are stored in any suitable memory device (hard drive, RAM, ROM, etc.) in the CPU and that contain graphical data for generating instructions for a printer. Such graphical data can include, for example, text with font and other formatting information, and bit-mapped or vector-based graphics. Such digital files include those produced by WYSIWYG (what you see is what you get)-type software applications or programs, which include word processing systems, desktop publishing programs, drawing and paint programs, computer aided drafting programs, digital photo applications, as well as any program or application that produces, opens or displays formatted text and/or graphics for printing.

Figure 2:
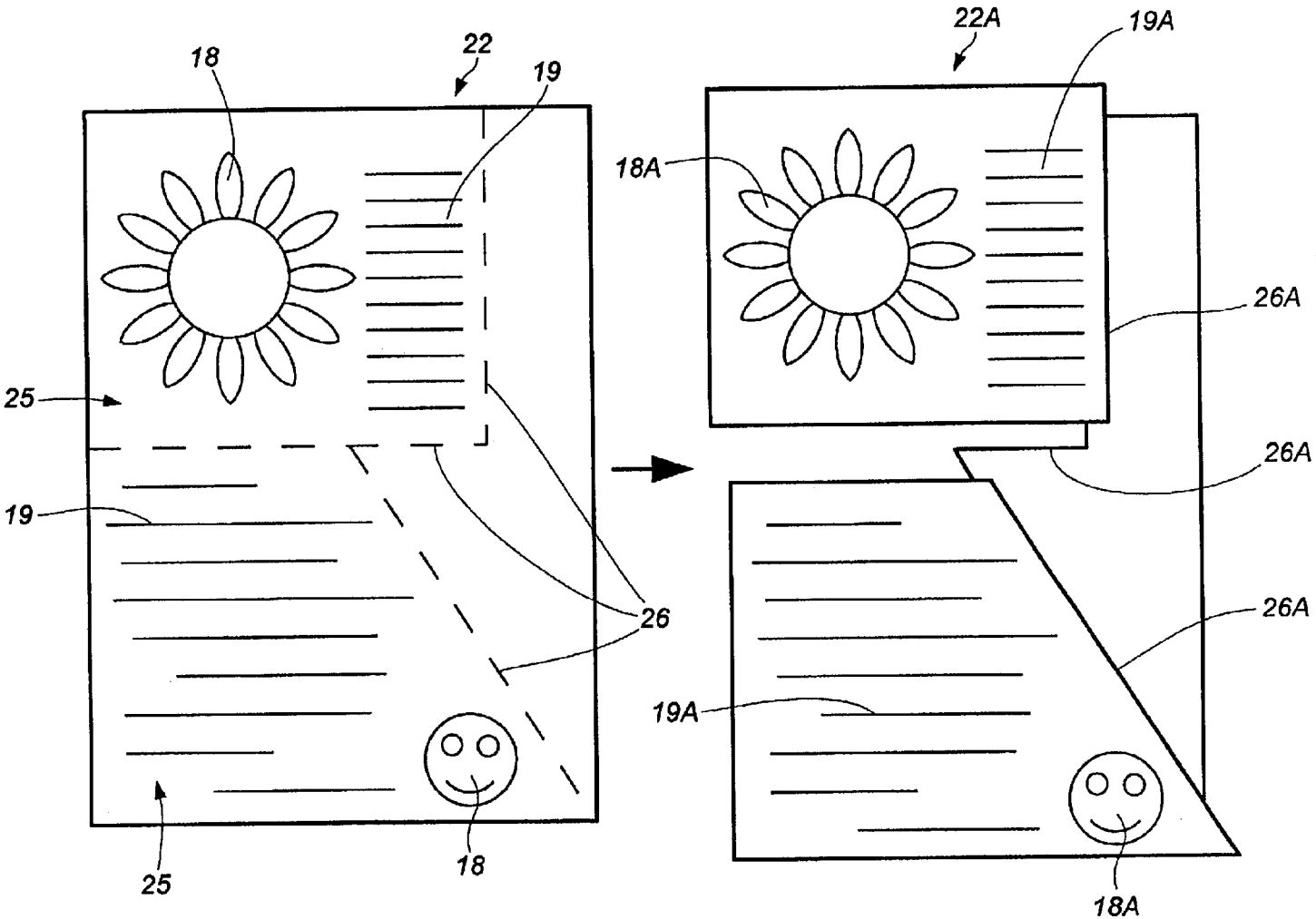
FIG. 2 is a view of a graphical representation and how it relates to the final document.

As shown in FIG. 2, a graphical representation 22 may contain text-type 19 and/or graphic-type 18 information which are depicted on the graphical representation as composite displays of printable objects 25. The representation also shows scoring indicia 26, which are more fully described below. The printed media or sheet 22A has corresponding textual and graphical elements 19A, 18A, respectively, that correspond to the appearance of the corresponding elements 19, 18 in the graphical representation. The printed sheet 22A also has score lines 26A at the locations of the corresponding scoring indicia 26 in the graphical representation. The sheet 22A is separated along the scored lines to create accepted portions of a desired shape containing the printable objects. The remaining rejected portions can then be discarded.

Figure 3:
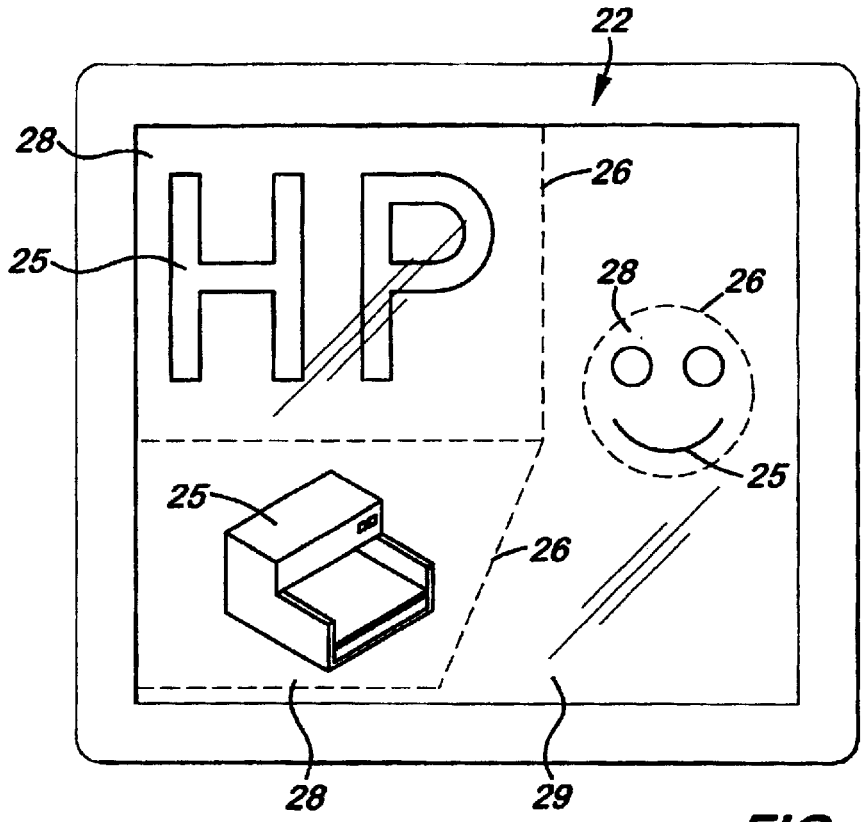
FIG. 3 is a view of graphical interface according to the invention showing a graphical image or representation of a document to be printed on a media, and showing indicia indicating score lines to be formed on the printed media.

Reference is now also made to FIG. 3, which is a detailed view of another graphical representation 22. The graphical presentation 22 on the monitor 23 the file represents the appearance of the file when it is printed. The graphical representation 22 can be generated by customized software or the application software used to create the file. In most software applications, this is accomplished using its Print Layout or Print Layout feature, or equivalent. Score indicia 26 (See FIG. 2) are then added to the graphical representation 22 using the user manipulatable input device 27, which may be, for example, a mouse, graphics tablet, joystick, touch pad, or keyboard (see FIG. 1). The score indicia 26 represent locations where scores will occur on the final document. Customized drawing-type software can be used for this function, or, alternately, "drawing" tools in the main application can be used. Using Microsoft Word 2000 as an example, while in Print Layout mode the Line tool is selected from the Draw toolbar and a line drawn over the display where a score line is desired. Other suitable tools, such as the Rectangle and Oval, could also be selected. The requirement is that a distinctive indicia indicating the position of the scores on the printed document be added to the graphic image, which indicia can be interpreted for the printer 30 as score lines or regions.

To differentiate indicia indicating a score 26 from other indicia and objects, such as those that are to be printed, the score indicia 26 can be given a distinct property, such as color or style, that isn't otherwise used in the file to identify indicia or objects. Using suitable software, that distinctive property is interpreted for the printer as a score line. Implementation of such software is straightforward, and could be accomplished much the same way colors or other properties are handled by printing subroutines. For example in certain prior-art printers, colors on a print preview display are interpreted for the printer by the print driver as a printable color or a printable shade of gray. In the present invention, instead of a printable color, the displayed color can be interpreted for a scoring printer of the invention as a score. The scoring printhead or apparatus in the printer is then activated by the software and the CPU in the same way a color printhead is activated. This could be done in the application by an add-on module to the main application or in a separate module from the main application, such as in a print driver. Using a print driver accessible to all applications, the invention could be used universally for any graphical application on the CPU if, for example, the driver is configured to score whenever a certain color or property in an application is displayed. Any application displaying that color or property for printing will activate the scoring mechanism of the printer. Print subroutines in the applications that create the digital files can also be suitably modified. In certain high-end graphic applications several existing indicia properties may be available. For example, in a high-end graphics application like AutoCad™ or CorelDraw™, the score indicia could be distinguished by any one of or a combination of layer, line width, line style, and line color of the indicia. With the multitude of colors and properties supported by most applications, a distinctive "score" property visible as a contrasting color or style in the displayed graphical representation 22 would be practical to achieve. This system would also allow a user to create an unscored draft copy on a media where the score regions are represented by printing. This could be done by using a non-scoring printer to print or by selectively disabling the scoring feature in the scoring printer of the invention. The score indicia may also be added by a software module that is entirely separated from the main application where the score indicia are distinguished by a new software "score" property, label or flag that can be interpreted as a score for the scoring printer.

In any event, the digital file or files represented on the graphical interface are modified by adding digital data for the score indicia. These files are then used by appropriate printer software routines to determine the location of graphical data and scores on the final printed document to send the appropriate data to the scoring printer. The files can then be saved and otherwise manipulated as provided by the operating system.

A score in the media, as used herein, is any region in the media that is sufficiently weakened such that under tensile, torsional, folding and/or shear forces that would tend to tear the media, the media will preferentially part or tear at the score. The score may be, for example, in the form a cut partially through the thickness of the media, or a series of perforations through the media. In paper, the score is usually characterized as a region, most often in the form of a line, where paper fibers have been fully or partially cut, or at least damaged.

A score also includes lines or regions where the media is weakened sufficiently to form a fold line, i.e., wherein upon a folding force the media preferentially folds along the fold line. Fold lines can be created by fiber displacement or minor damage to fibers (e.g., see FIG. 5) resulting from a sparse or widely spaced score pattern (e.g. see FIGS. 16A, 16D), Since the score indicia 26 indicate where the printed sheet or media will be scored, the indicia are usually formed as lines to correspond to media scores, which are usually in curved or straight lines. Points, solid shapes, multiple lines, and the like, would usually not be used, but are contemplated by the invention if special circumstances require the same. For example, if the score lines define a complex, convoluted or closely spaced region to be removed, it may be easier to remove a discarded portion if it is entirely weakened by scores in the form of multiple score lines or a completely perforated area. In addition, a score line may be made weaker by double or overlapping lines of scores.

Reference is now made again to FIG. 3. The graphical representation 22 shows graphical or printable objects 25 depicted as they will appear in the printed document. At locations determined by the user through the user interface 27, score indicia 26, here in the form of dotted lines, are added, which indicate where the final document is to be scored. The score indicia 26 define regions 28 which represent accepted portions of the media, and regions 29 which represent portions that will be rejected by the user. These regions 28, 29 may be any shape desired by the user, including regular geometric shapes and irregular open or closed shapes, which may include straight, curved, and convoluted lines.

After the scoring indicia 26 have been added in the graphical representation and the indicia data added to the digital files or files, the files are processed by the CPU and suitable printing data is sent to a scoring printer 30 of the invention. The printing may be initiated from the software application in the conventional manner by using the normal print or plot commands and routines. Alternately, customized printing/scoring software routines may be used.

Figure 4:
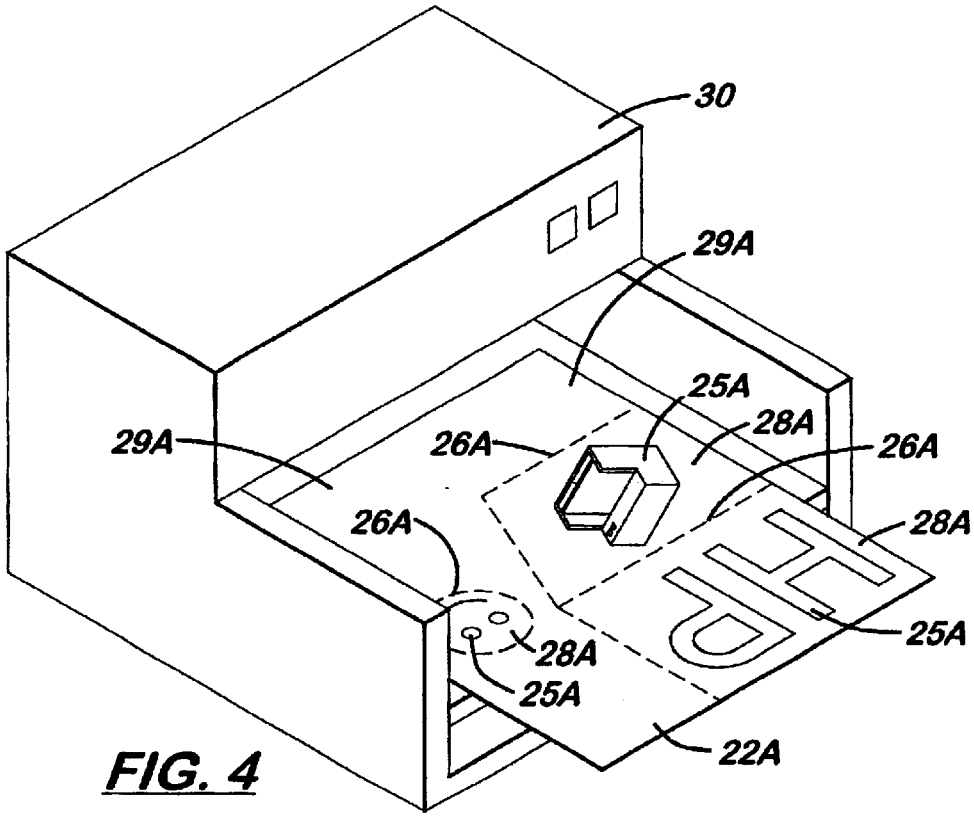
FIG. 4 is a printed media made according to the invention with a printed image and score lines corresponding to the indicia n in FIG. 3.

Reference is now made to FIG. 4. The scoring printer 30 applies printed images 28A to the media sheet 22A and applies scoring lines 26A to the print media as represented on the graphical representation 22. It is preferred that the scoring operation not require additional intervention by the user beyond the adding the graphical scoring indicia. Accordingly, both the printing and scoring are done on the printer without user manipulation of the media. The scoring should be seen by the user as part the "printing" operation. Scoring systems that are incorporated into the printing mechanism and score the media essentially concurrently with the printing are preferred. These may operate in much the same way as in color printers where a second color is printed concurrently with the first color of the image. A scoring head used in tandem with a moving printhead, as described in detail below, is preferred.

Figure 5:
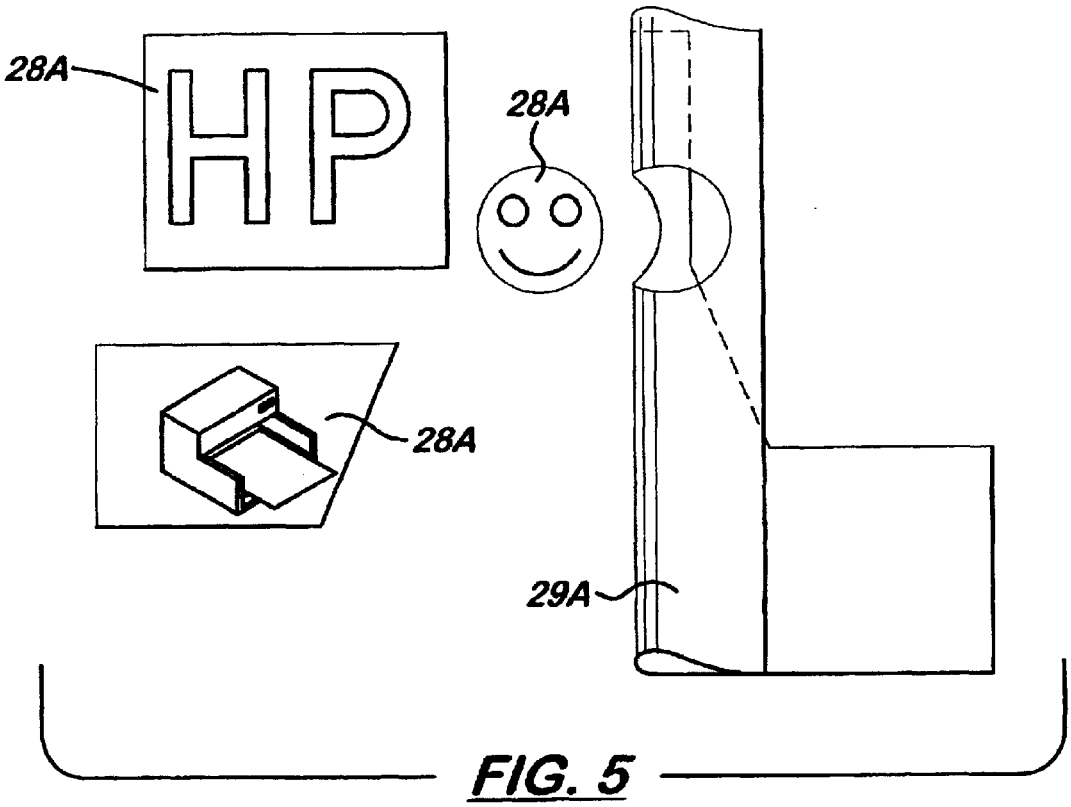
FIG. 5 is the printed media of FIG. 4 with accepted and rejected portions separated along the score lines.

Reference is again made to FIG. 3 and FIG. 4. When the document is printed, the printable objects 25 and score indicia 26 represented on the graphical representation are respectively formed on a blank media as printed image elements 25A and score lines or elements 26A, forming the final printed and scored sheet 22A. Referring also to FIG. 5, the printed and scored sheet 22A can be separated along the score elements 26A into accepted portions 28A and rejected portions 29A by manually tearing the sheet along the score elements 26A.

While any media is contemplated by the invention, properties of the media must be considered with the design of the scoring apparatus since the scoring apparatus must physically alter the media. Accordingly, for certain scoring printer designs, a thick media, or a media with a dense or hard surface may be unsuitable. Suitable plastic media are contemplated using a scoring printhead design with pins that cut, rather than tear, the media. However, it is within the skill of a practitioner to adapt the scoring apparatus to any media.

In general, it is contemplated that the main use of the invention is in integration with low volume printer systems used in home and business environments, such as moving head inkjet printer systems used for monochrome and multicolor printing. The scoring apparatus should be designed to successfully score paper media usually used in these types of printers, such as the common 20 to 24 lb inkjet and copier papers, as well as heavier papers up to about 40 lb, and papers with gloss or matte finishes.

Scoring Printer Construction.

Figure 6:
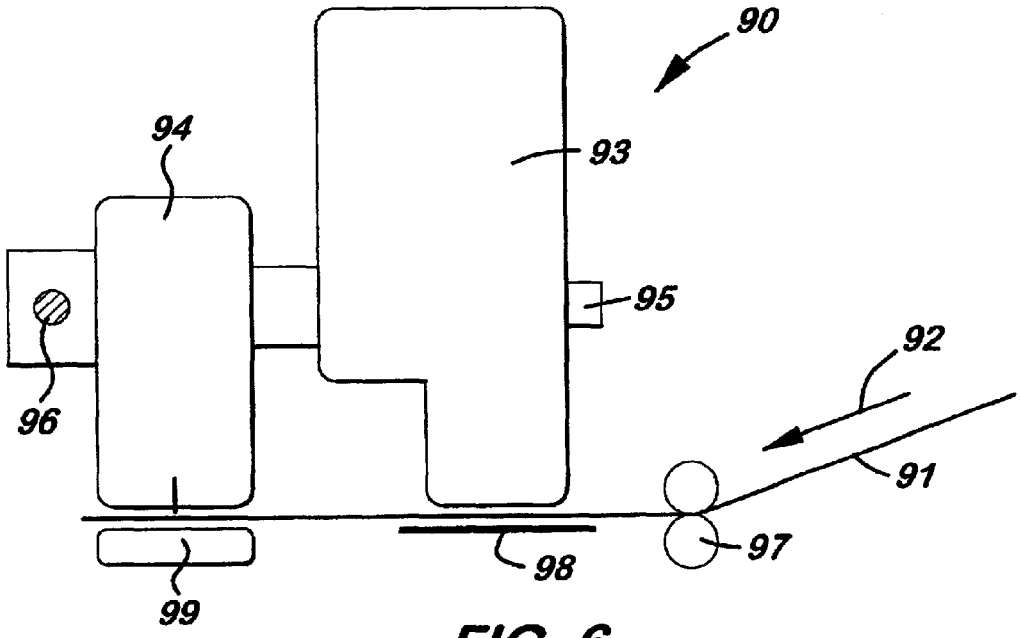
FIG. 6 is a schematic of a scoring printer according to an embodiment of the present invention.

One aspect of the invention is now illustrated with reference to FIG. 6, which is a schematic of an imaging section 90 of a scoring printer of the invention, showing the media 91, media path 92, printing head 93, and scoring head 94. The imaging section 90 is of the moving-head type with a scoring head 94 and a printing head 93 mounted in tandem on a moving carriage 95 that moves, for example, on a horizontal rod 96. The carriage 95 transports both heads 93, 94 across the media surface along a transverse axis. Separate carriages for each head 93, 94 are also contemplated. A media transport 97 moves the media between the heads 93, 94 and respective media supports 98, 99 in a longitudinal direction along the media path. The printing head 93, the media support 98, the moving carriage 95, the media transport system 97 and other supporting structures and systems may be essentially the same as that found on known moving head printers. The moving printhead 93 is of any suitable construction, including inkjet (piezo- or thermal), thermal, and impact dotmatrix. There may also be additional printheads, such as for color printing. For color printing there may be 3 or 4 print heads mounted on the carriage, or a single multichambered print head in the case of an inkjet printer.

While the invention has been described in conjunction with a moving-head printer, it is understood that the scoring head could be used together with other imaging systems, such a moving paper plotter, or a flat bed plotter, with the scoring head mounted with or in a similar manner to the printing head. In addition, the invention could be applied to any imaging system where a scoring head module could be added before or after the imaging step. For example, in a laser imaging system a scoring system according to the invention could be added at the output of the laser imaging system to score printed pages as they come from the imaging system.

The scoring head 94 is mounted on the carriage 95 with the print head 93. The scoring head 94 has a scoring mechanism that comprises selectively activated scoring pins. The mechanism of the scoring head is similar to that of a dot-matrix impact printer, except the pins function to perforate the media rather than impact and form an image. Accordingly, the ends of the pins are constructed differently, and there is no ink ribbon or ink transfer associated with the scoring head. In addition, the media support 99 under the impact area is designed to endure repeated impacts from the scoring pins without serious functional deterioration. Suitable materials for the media support include, but are not limited to, elastomers and plastics, self-healing mat material, neoprene, rubber and polyurethane.

Figure 7:
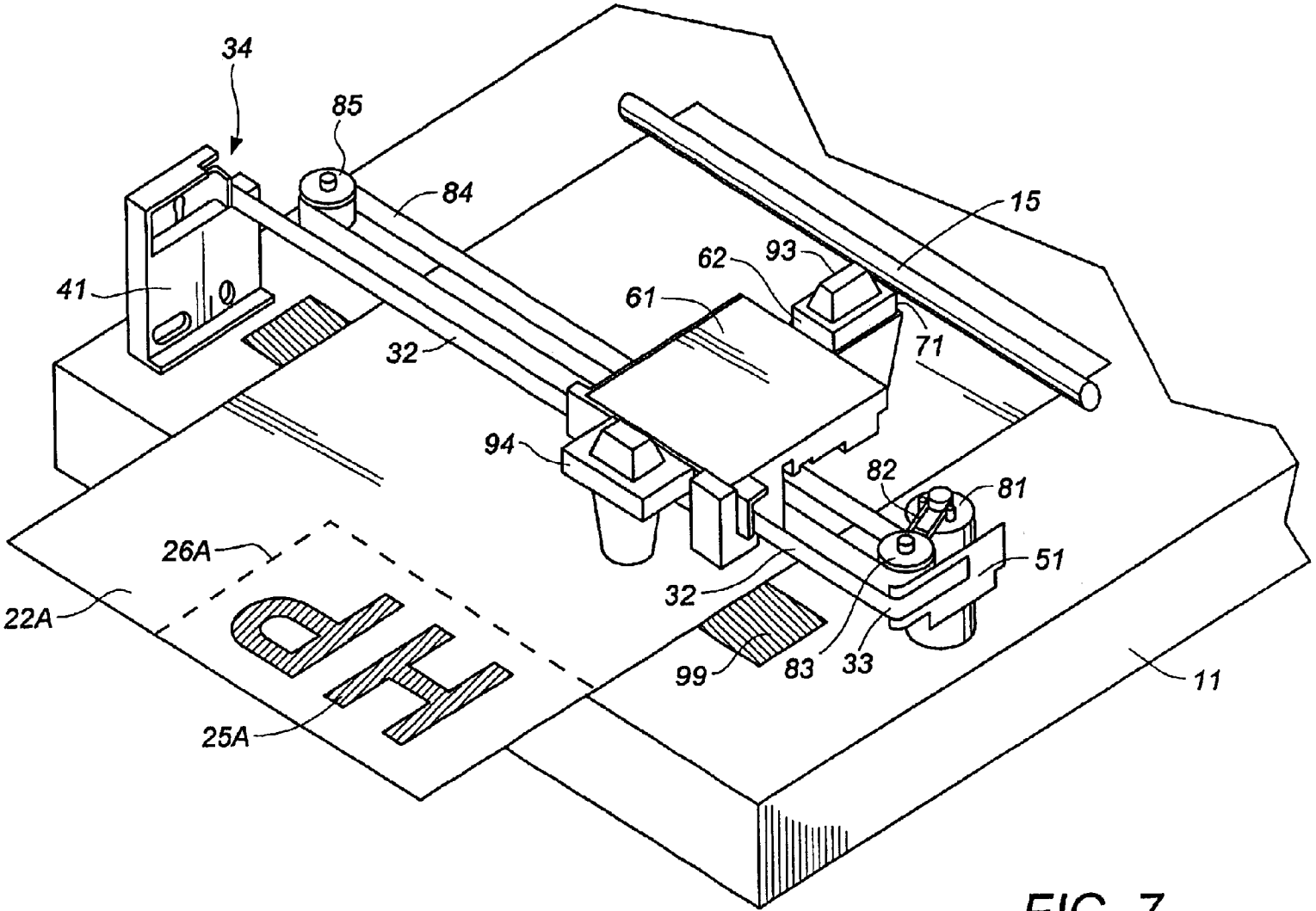
FIG. 7 is a schematic of a scoring printer according to an embodiment of the present invention, showing a carriage with a conventional print head, a scoring head, and carriage drive.

Reference is now made to FIG. 7 is a schematic showing a portion of a scoring printer of the invention. The scoring printer of FIG. 7 includes a housing 11, shown in part. A roller 15 holds and transports a sheet 22A, on which printed elements 25A are formed. Within the housing 11 is the codestrip 32 which extends along its major portion across the media between points 33, 34 near its ends where the codestrip 32 is wrapped ninety degrees around each of two respective stanchions 41, 51.

The codestrip 32 is threaded through a carriage 61, which carries a printhead 93 that comprises a transducer holder 62 and transducer 71 (such as a thermal-inkjet pen). The carriage is driven to left and right by a drive train 81–85.

The drive train includes a servomotor 81, which powers a small endless belt 82. That belt rotates a driven idler 83, which in turn powers a long carriage-connected endless belt 84. The latter also encircles an undriven idler 85.

Any system is suitable that provides sufficient positional precision for effective coordination of the printhead 93 and the scoring head 94, each positioned in respective locations on the single carriage 61. Such a system is disclosed in U.S. Pat. No. 5,276,970, which is hereby incorporated by reference. Suitable systems include transmission-type sensors mounted on the carriage 61 and work in association with the code strip 31 as disclosed in U.S. Pat. No. 5,276,970, which is also incorporated by reference.

As the media sheet 22*a* is transported under the carriage 61 by the media transport 15, the carriage is moved to appropriately position the printhead 93 for application of the printed elements 25A and the scoring head 94 for application of the score elements 26A. The scoring head 94 is mounted on the front edge of the carriage, and the media support 99 under the scoring head 94 is of a resilient material to withstand impact from the perforating pins of the scoring head.

Figure 8:
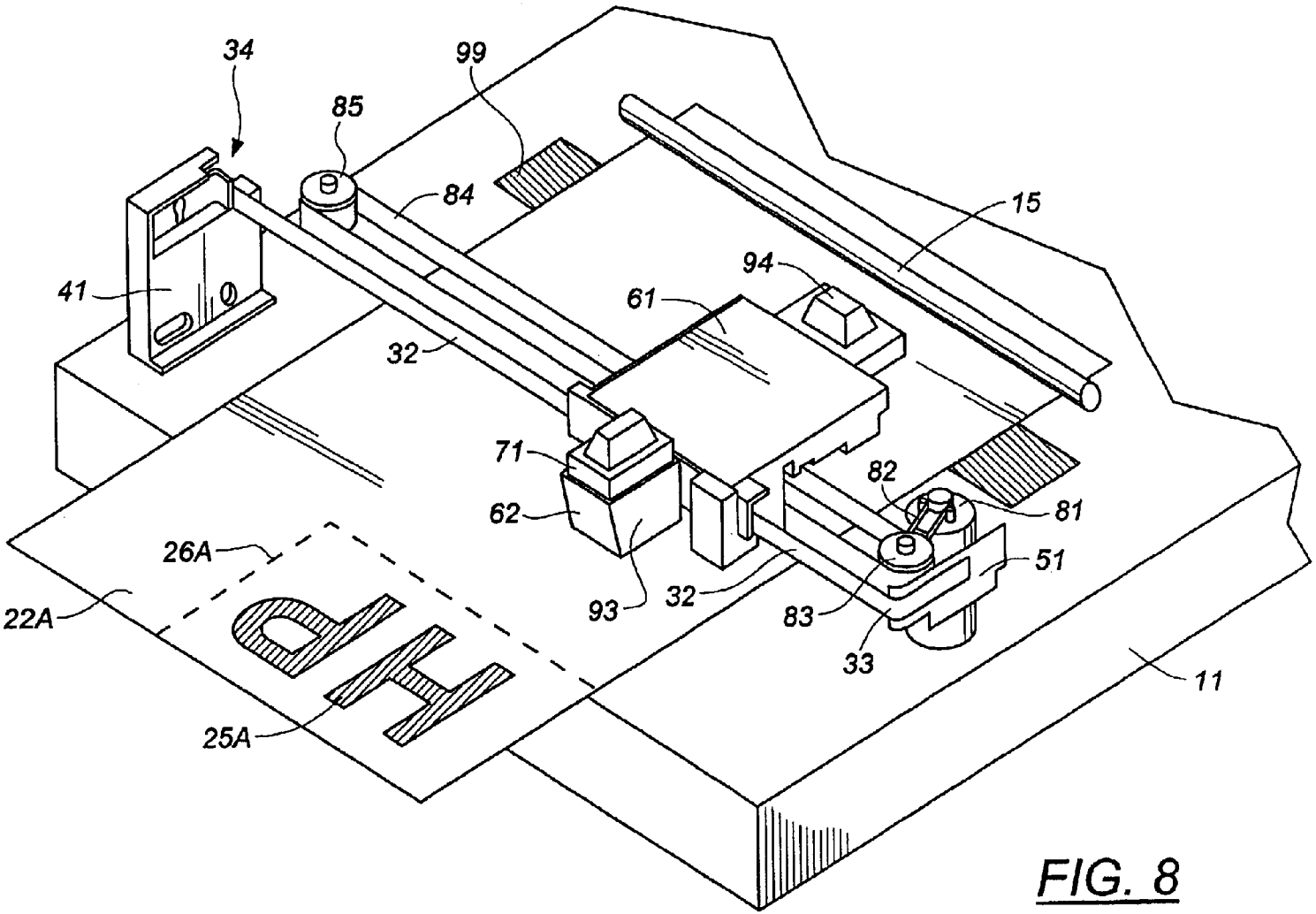
FIG. 8 is a schematic of another scoring printer according to an embodiment of the present invention, showing a carriage with a conventional print head, a scoring head, and carriage drive.

Reference is now made to FIG. 8, which shows a scoring printer similar to that shown in FIG. 7 except the printhead 93 is shown on the front of the carriage and the scoring head 94 is shown on the rear edge of the carriage 61. In addition, the media sheet is shown in partial section to better show the resilient media support 99 under the path of the scoring head 94.

Figure 9:
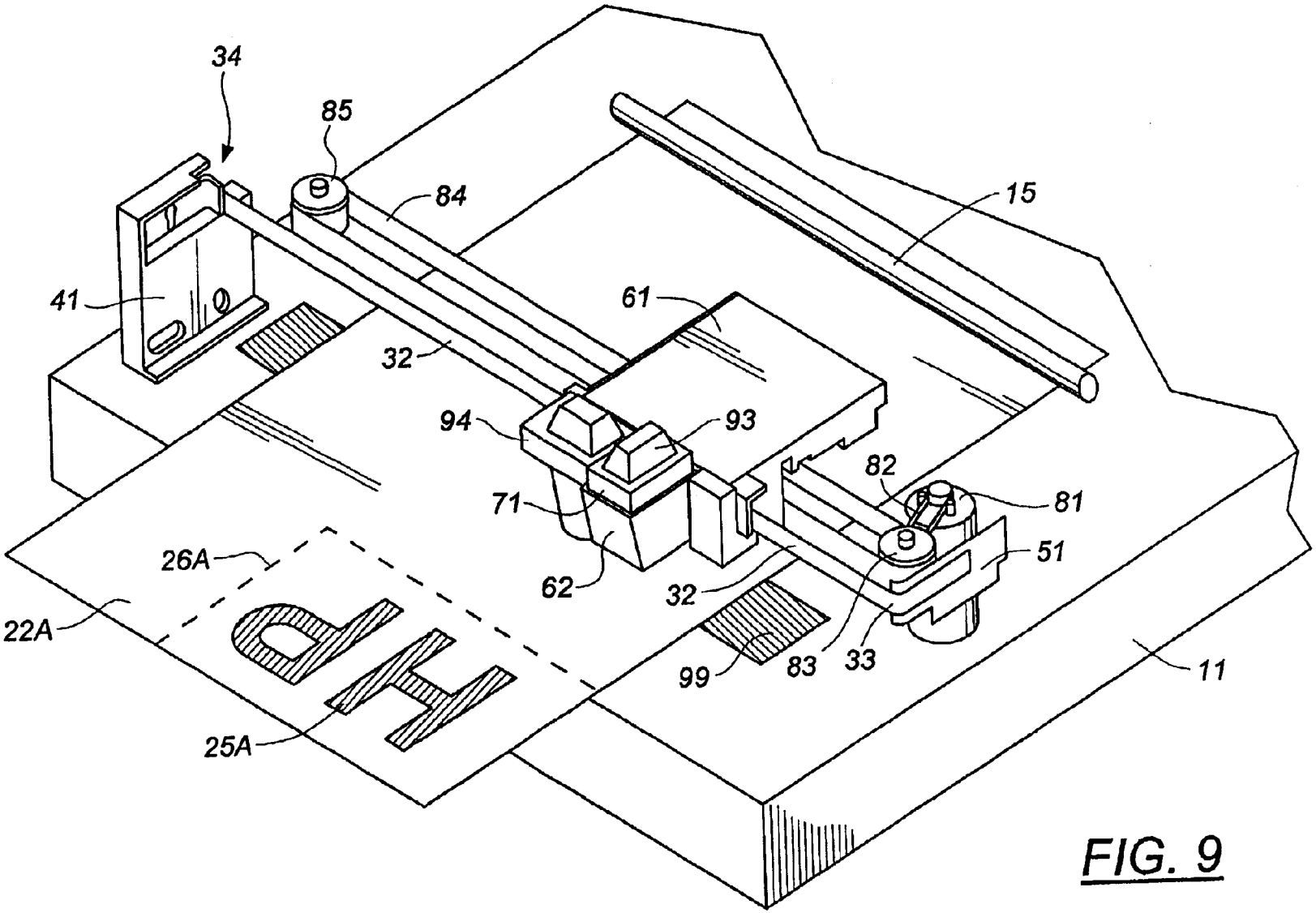
FIG. 9 is a schematic of another scoring printer according to an embodiment of the present invention, showing a carriage with a conventional print head, a scoring head, and carriage drive.

Reference is now made to FIG. 9, which shows a scoring printer similar to that shown in FIG. 7 except the printhead 93 and the scoring head 94 are shown on the front edge of the carriage 61.

Perforating Pins for Scoring Printer

The perforating pins are activated in a manner similar to impact printing pins with sufficient force to push the pins through the media. With reference to FIGS. 10A—F, which show pin ends from perspective views, the points of the pins are designed to weaken the media. In design of the pins and the print head there is a balance, for the less damage caused by the pins, the more closely the pin penetrations must be to achieve a score line. Thus a penetration that causes only a dimpling is contemplated where the dimples are spaced close enough together to sufficiently weaken the media. For some media-types, such as plastic media, cutting may be required for a tear-line, although dimpling may be sufficient for a fold line.

Accordingly, the pin may have any suitable tip that weakens the media.

Figure 10C:
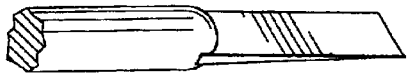
FIGS. 10A–10F are schematic drawings showing exemplary shapes of the tips of perforating pins used in a scoring printer according to an embodiment of the present invention.
Figure 10F:
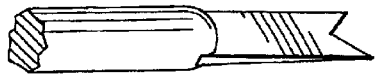
Figure 10B:
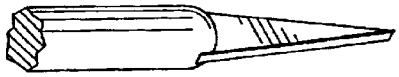
Figure 10E:
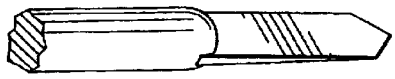
Figure 10A:
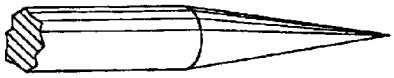
Figure 10D:
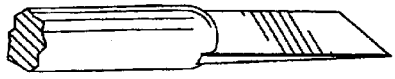

As example, FIG. 10A, shows a pointed end. FIG. 10B shows a pointed end associated with cutting edges to cut the media. FIG. 10C shows a cutting pin tip shaped like a screwdriver tip. FIG. 10D is similar to FIG. 10C, but with a slanted and widened cutting chisel-like end. FIGS. 10E and 10F show radiating cutters. Symmetrical designs are preferred to avoid bending forces that could deform the pin during penetration or cause premature pin failure.

As described, above, the perforated pins are activated in a manner similar to impact printing pins. In other aspects the operation and construction of the scoring head are essentially the same for an impact printing head. Prior-art color printers have been constructed with two or more print heads mounted in tandem on a moving carriage, and the operation and activation of the print head and scoring head can be accomplished by adapting known tandem print head technology.

Although, there are similarities between impact printing heads and the scoring head of the invention, some considerations must be made in light of the different function of the scoring head. A prior-art impact printing head usually has 9 or 24 impact pins arranged in a linear matrix. The scoring head of the invention may not require as many pins since the "print" resolution requirement of the scores may not be as high as for a printed image. Any head with at least one pin is contemplated. However, sufficient pins should be present so that all of the score perforations in a raster line can be accomplished with one pass of the scoring head. Preferably the scoring head is activated in the same pass that printer heads are activated. The speed of the carriage and timing of pin activations should be adjusted to permit pin penetration of the media while avoiding breakage of the pins. It should be noted that speed is not as high a consideration for the scoring head of the invention as it is for impact printing heads, because scoring usually represents a small portion of the document, and slowing the print carriage to accommodate scoring will not seriously slow the overall printing operation.

The diameter of the perforating wire or pins may also be larger than impact wires to increase strength, where resolution of perforations is not as critical as for printing. The number of wires may optionally be decreased or the wires in the array may be staggered to accommodate the larger diameter. The latter solution also has the advantage that the individual perforations in the media will be closer or overlapping, which increases the weakness of the score.

Impact print heads usually comprise impact pins driven by an electromagnetic coil operably connected to the pin by a lever. For a scoring head the printer, the construction is similar except perforating pins are used in place of the impact pins. For a scoring head the dimensions of the coil and lever may be adjusted to achieve a proper perforating pin throw length, and sufficient penetrating force to allow the perforating pin to penetrate a media. Electromagnetic activated pin systems are common constructions that are suitable for the present invention. Examples of such systems are those disclosed in U.S. Pat. Nos. 5,540,508, 5,518,327, 5,449,239, 5,213,423, 4,767,227, and 5,039,235, which are hereby incorporated by reference. Other systems, using electrodistortion or piezoelectric elements to activate the perforating pin are also suitable. Suitable systems are disclosed in U.S. Pat. Nos. 5,005,994, 5,292,201, which are hereby incorporated by reference.

Scoring Head A

Figure 11:
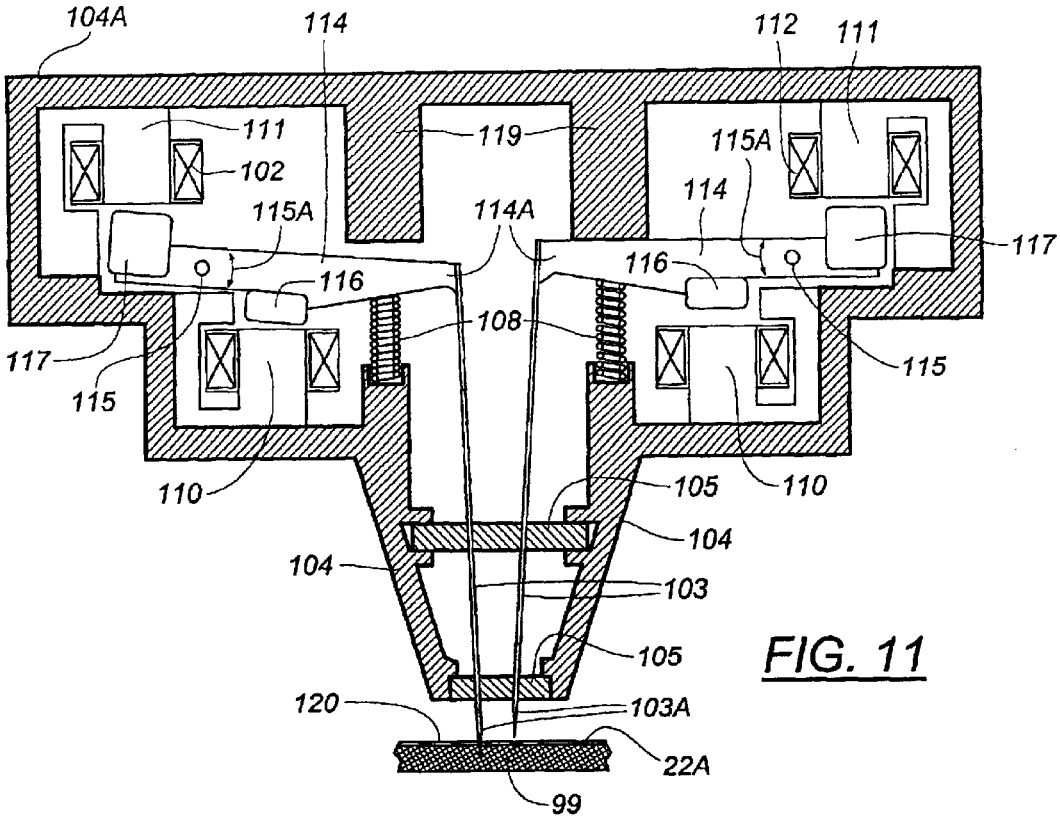
FIG. 11 is a schematic cross-section showing an exemplary construction of an electromagnetically activated scoring head according to an embodiment of the present invention.

Reference is now made to FIG. 11. An exemplary scoring head comprises a plurality of levers 114 mounted for rotation about axis 115, two such levers being illustrated in the figure. Levers 114 are mounted on rotational axis 115 via a bearing (not shown) in order that lever 114 will rotate as indicated by arrow 115A. The forward end 114A of levers 114 are each respectively secured to perforating pins or wires 103 which are moveably supported in one or more guides 105 in head nose 104. Plungers 116 and 117 are mounted on either side or opposite sides of axis 115 of each lever 114 in alignment with their respective cores 110 and 111. Plungers 116 and 117 comprise soft magnetic material, i.e., a high magnetic permeable material such as pure iron, silicon steel, etc. Electric coils 101 and 102 are respectively mounted on cores 110 and 111. In the illustration two plungers are shown, but one plunger on either side of the fulcrum may also be used. For two plungers, magnetic influencing means comprises two magnetic circuits which are employed relative to each lever 114 at opposite sides of rotation center 115, one circuit comprising core 110 and its yoke, plunger 116 and coil 101 and the other circuit comprising core 111 and its yoke, plunger 117 and coil 102.

Lever 114 illustrated in the upper portion of FIG. 11 is shown in its activated position with its perforating wire 103 extended from nose 104. Lever 114 in the lower portion of FIG. 11 is shown in its deactivated, rest or standby position wherein perforating wire 103 is retracted in nose 104. In its standby position, lever 114 is held against abutment 119 by means of compression spring 108.

In operation, plungers 116 and 117 of lever 114 are attracted respectively to cores 110 and 111 under the influence of the magnetic flux generated by coils 101 and 102. As a result, lever 114 is rotated so that its connected wire 103 extends to a perforating position illustrated in the upper portion of FIG. 11 with the cutting or penetrating end of wire 103 striking and penetrating paper media 22A and striking media support 99 before plungers 116 and 117 contact their respective cores 110 and 111. The magnetic attraction supplied by the magnetic circuit of coils 101 and 102 is sufficient to overcome the compression force of spring 108 and move lever 114 away from abutment 119. Release of lever 114, to return the lever to its standby position against abutment 119 as illustrated in the lower portion of FIG. 11, is accomplished by termination of current flow in coils 101 and 102 and the compression force of spring 108.

Besides the employment of two plungers for each lever 114, the distance between rotational axis 115 and lever end 114A secured to perforating wire 103 on one side of lever 114 is longer than the distance between rotational axis 115 and plunger 117 secured on the other side of lever 114. This results in greater displacement of lever end 114A relative to smaller displacement at plunger 117 upon rotational movement of lever 114 to its activated position. These lengths can be adjusted to achieve the proper displacement for penetration of the tip 103A of the penetrating wire into the media 22A. Since there are two plungers 116 and 117 for each lever affixed on opposite sides of rotational axis 115, angular movement at lever end 114A will be comparatively greater and, in combination with increased striking acceleration of perforating wire 103.

Scoring Head B

Figure 12:
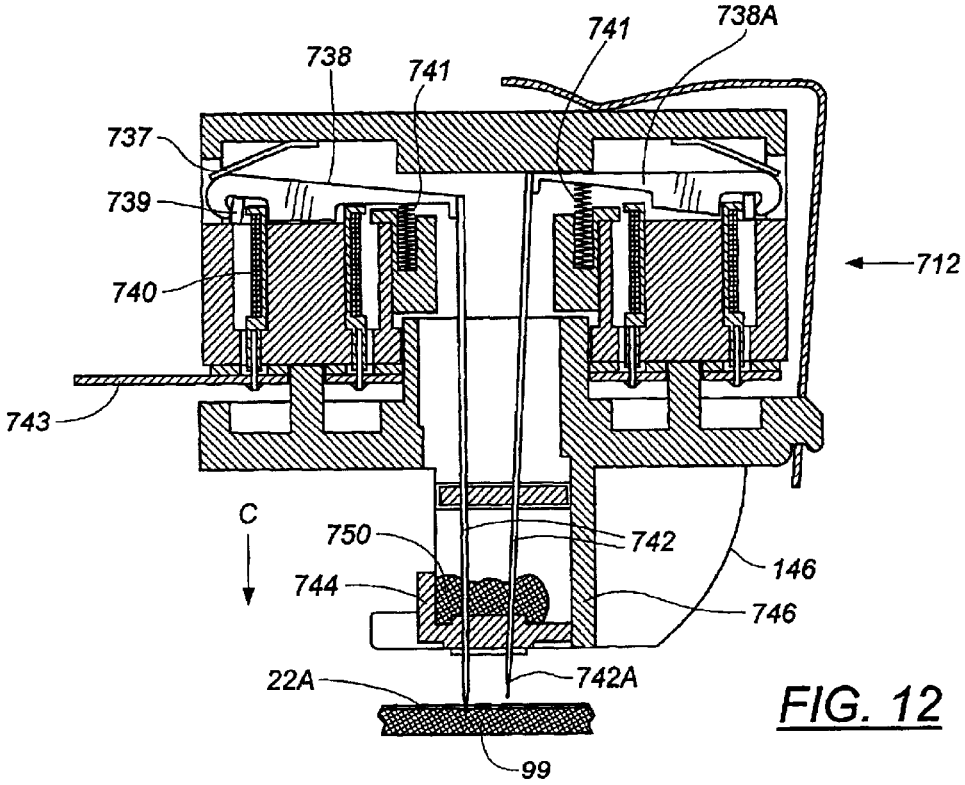
FIG. 12 is a schematic cross-section showing another exemplary construction of an electromagnetically activated scoring head according to an embodiment of the present invention.

Another suitable construction of a perforating or scoring head is shown with reference to FIG. 12, which shows the basic operation of the perforating head and the basic construction of parts of a perforating head 712. The perforating head includes a plurality of perforating pins such as wires 742, each coupled to an electromagnet 740 by a lever 738 pivotable about member 739 and held securely in position by spring member 737. Lever 738A is shown in a raised position biased upwardly by spring 741 thereby holding its attached perforating wire in a retracted position so long as its associated electromagnet is not activated. Electromagnets 740 are energized at appropriate times by a driving current applied through circuit board 743 and an electromagnetic attracting force generated thereby pulls lever 738 downwardly to cause its attached perforating wire 742 to project in the direction indicated by arrow C. Each wire 742 is preferably supported by one or more guides. Particularly, a tip 742A of each wire 742 is supported by a front end guide member 744, which is held in place by a nose 746 which serves as a guide holding member. A lubricant 750 is injected into and preferably stays in a portion of the scoring head located behind the front end guide 744. Lubricant 750 may include, for example, naphthene oil, paraffin oil and olefin oil. When perforating wires 742 are energized, they project in the direction of the print sheet media 22A. The print sheet 22A is supported by compliant support 99.

Scoring Head C

Figure 13:
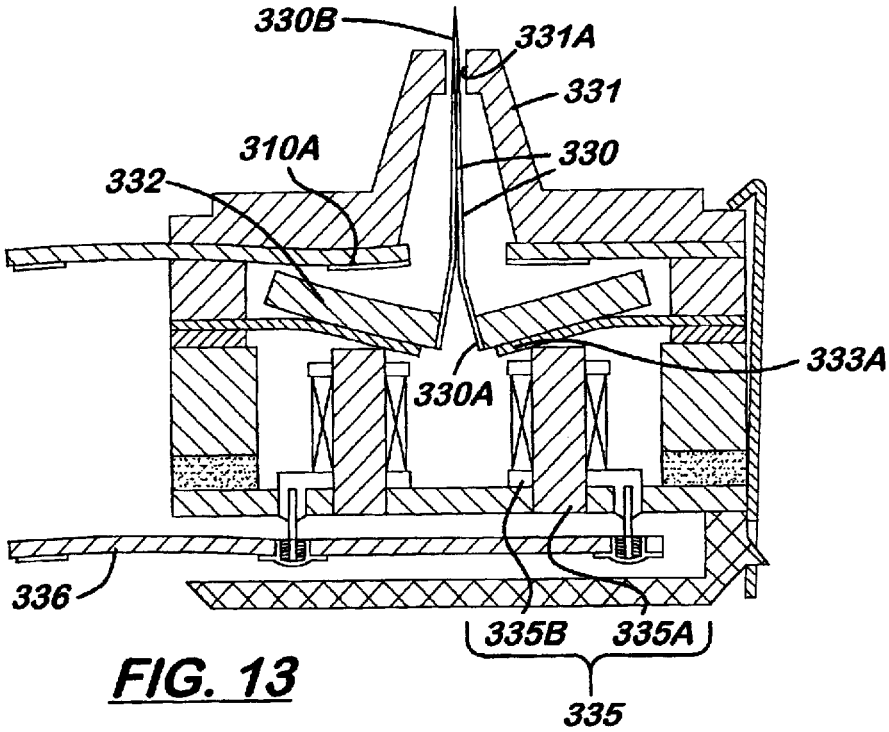
FIG. 13 is a schematic cross-section showing yet another exemplary construction of an electromagnetically activated scoring head according to an embodiment of the present invention.

Another suitable design for a scoring head is now described with reference to FIG. 13. A plurality of perforating wires 330 disposed in a wire dot head in a generally radial arrangement. In FIG. 13 the view is from the side and only two perforating wires are shown. Front cover 331 has a guide hole 331*a*, which guides the perforating wires 330. An armature 332 composed of a magnetic substance is supported by a leaf spring 333. Electromagnet 335 has a head coil 335B wound around a core 335A. A printed circuit board 336 has printed lines and connector terminals (not shown) that supply a current to the electromagnet 335.

The armature 332 is supported on a free end 333*a*A side of the leaf spring 333. A base portion 330A of each of the perforating wires 330 is secured to an edge of the armature 332. The pointed end 330B of each of the perforating wires 330 is guided to a guide hole 331A of the front cover 331 so that the perforating end 330B is directed on the media (not shown) to penetrate the media when current is supplied to the electromagnet.

Scoring Head D

Figure 14:
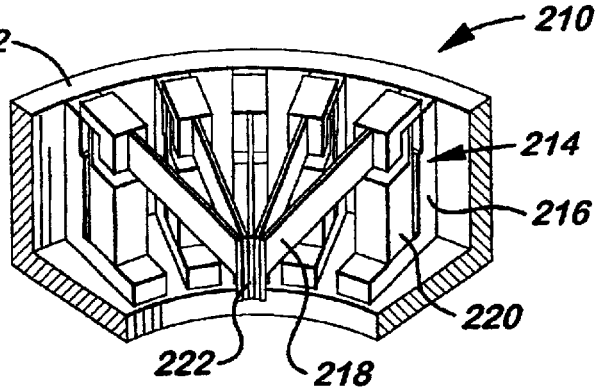
FIG. 14 is a schematic cross-section showing an exemplary construction of a piezoelectically activated scoring head according to an embodiment of the present invention.

Reference is now made to FIG. 14 describing an electrodistortion or piezoelectric scoring head design. A scoring head 210 is comprises a cylindrical housing 212 and a plurality of actuators 214 arranged in the cylindrical housing 212. Each actuator 214 is constituted of a base member 216, a movable member 218, and a piezoelectric device assembly 220. A perforating wire or pin 222 is fixed to an end of the movable member 218.

Figure 15:
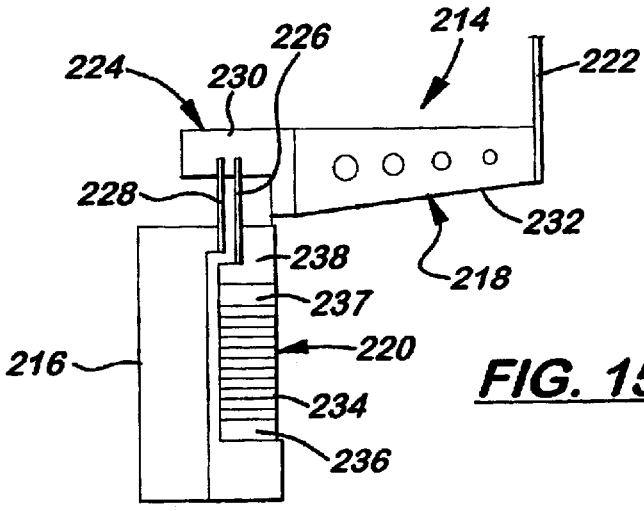
FIG. 15 is a schematic of the actuator used in the scoring head of FIG. 14

A detailed structure of the actuator 214 will now be described with reference to FIG. 15. The movable member 218 is constituted of an armature 230 and a beam 232 brazed to the armature 230. The perforating wire 222 is fixed to an end of the beam 232. A displacement enlarging mechanism 224 is constituted of the movable member 218 and a pair of leaf springs 226 and 228 disposed in substantially parallel relationship to each other. The piezoelectric or electrodistortion device assembly 220 is constituted of a block 236 fixed to the base member 216, a electrodistortion or piezoelectric device 234 fixed at its one end to the block 236, a block 237 fixed to the other end of the piezoelectric device 234, and a movable block 238 bonded to the block 237. One end of the leaf spring 226 is brazed to the movable block 238 of the piezoelectric device assembly 220, and the other end of the leaf spring 226 is brazed to the armature 230. On the other hand, one end of the leaf spring 228 is brazed to the base member 216, and the other end of the leaf spring 228 is brazed to the armature 230. The piezoelectric device may have any suitable construction, such as disclosed in U.S. Pat. No. 5,292,201.

Suitable Score Patterns from Perforating Pin Scoring Heads

Reference is now made to FIG. 16. As indicated above, the function of the scoring head is to create regions of weakness or scores on the media. With the penetrating pin scoring heads of the invention, this may be by any suitable dot pattern. Usually the print head of an inkjet or impact dot-matrix type is constructed with a linear matrix of jet or impact pins with the direction of the matrix generally perpendicular to the movement of the carriage. However, it is contemplated to mount the printing head with the matrix mounted in line with carriage movement. In such a case, the media transport could move or pass the media under the head while print elements are applied.

Figure 16A:
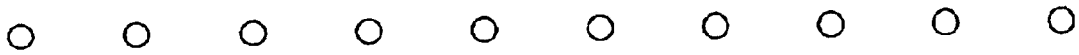
FIG. 16 is a schematic of patterns of perforations created by a perforating scoring printer according to an embodiment of the present invention.
Figure 16B:
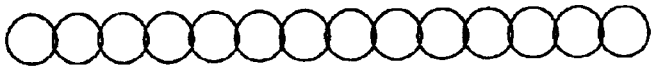
Figure 16C:
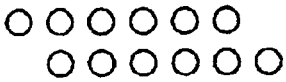
Figure 16D:
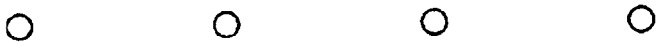

The scoring head, which preferably has a matrix of linearly mounted penetrating pins, can be mounted in a similar manner to that of the print head. The "image" or pattern of penetrations in the media is made to provide sufficient weakening of the media to create a score. Suitable exemplary patterns are shown in FIGS. 16A–16D as follows: FIG. 16A is simple line of penetrations; FIG. 16B is a line of overlapping penetrations; FIG. 16C is a double line of penetrations; and FIG. 16D is a sparse or widely spaced score pattern that may be suitable for forming a fold line. Here some of the score pattern lines are shown with penetrations staggered (see FIG. 16C), and all the penetrations are shown as evenly spaced. But penetrations in line and/or randomly spaced are also contemplated.

While this invention has been described with reference to certain specific embodiments and examples, it will be recognized by those skilled in the art that many variations are possible without departing from the scope of this invention, and that the invention, as described by the claims, is intended to cover all changes and modifications of the invention which do not depart from the scope of the invention.

What is claimed is:

1. A moving-head printer system for printing and scoring media comprising:

a printhead;

an impact scoring head comprising at least one selectively activated driven perforating pin;

a moving carriage upon which are mounted the printhead and the impact scoring head, the carriage configured and constructed to move the printhead and impact scoring head across a surface of the media;

a printing actuator that activates the printhead to selectively apply an image element to the media as the print head passes over the surface; and a scoring actuator that activates the scoring head to selectively direct the at least one selectively activated driven perforating pin against the media in a predetermined pattern as the scoring head is passed over the surface;

wherein the impact scoring head includes a scoring actuator that directs the at least one selectively activated driven perforating pin recipricatorily at least partially into the printing surface a plurality of times forming a series of perforations, and the at least one selectively activated driven perforating pin includes an end sized and shaped to weaken the media where such contact occurs.

2. A printer system as in claim 1 wherein the printhead is of a type selected from the following group: inkjet, thermal inkjet, piezo inkjet, thermal dye, and impact dot matrix.

3. A printer system as in claim 1 wherein the at least one selectively activated driven perforating pin includes one or more selectively activated perforating scoring pins having a shape selected from the following group: single point, multiple point, tapered point, notched points, flat edge, and tapered edge.

4. A printer system as in claim 1 wherein the predetermined pattern is selected from the following group: horizontal lines, vertical lines, diagonal lines, curved lines, and double lines.

5. The system of claim 1 including media support including an elastomeric surface configured to support the surface of the media opposite the at least one selectively activated perforating pin.

6. The system of claim 1 including a media support having a self-healing mat material configured to support the surface of the media opposite the at least one selectively activated perforating pin.

7. The system of claim 1, wherein the scoring actuator includes an electromagnetic actuator.

8. The system of claim 1, wherein the scoring actuator comprises one of an electrostatic or a piezo electric actuator.

9. The system of claim 1, wherein the at least one selectively activated perforating pin reciprocates between a first extended position at least partially into the printing surface and a second retracted position and wherein at least one pin is resiliently biased towards one of the first position and the second position.

10. The system of claim 1 including a lubricant contacting the at least one selectively activated driven perforating pin.

11. The system of claim 1, wherein the scoring head includes a reservoir containing a lubricant through which the at least one selectively activated driven perforating pin extends.

12. The system of claim 1, wherein the at least one selectively activated driven perforating pin is coupled to at least one lever which pivots less than 360 degrees about a pivot axis.

13. The system of claim 1, wherein the carriage is configured to move along a first axis, wherein the printhead includes a linear matrix of pins parallel to the axis.

14. The system of claim 1, wherein the at least one selectively activated perforating pin has an end selected from a group of ends including a pointed end, a pointed end having cutting edges, a cutting pin tip shaped like a screwdriver tip, a cutting pin tip shaped like a screwdriver tip having a slanted and widened cutting chisel-like end, and a radiating cutting end.

15. The system of claim 1, wherein the scoring actuator directs the at least one selectively activated driven perforating pin recipricatorily completely through the printing surface.

16. The system of claim 1 including a housing, wherein the end of the at least one perforating pin moves between a retracted position within the housing and an extended position beyond the housing.

17. The system of claim 16, wherein the housing extends about the scoring actuator.

18. A carriage printer system for printing and scoring media comprising:

a carriage-mounted printhead;

a carriage-mounted impact scoring head including at least one selectively activated driven perforating pin;

a media transport mechanism to move the media relative to the printhead and relative to the scoring head in a media advance direction;

a printing actuator that activates the printhead to selectively apply an image element on a printing surface of the media; and a scoring actuator that activates the impact scoring head to selectively move the at least one selectively activated driven perforating pin recipricatorily at least partially into the printing surface a plurality of times against the printing surface of the media as the impact scoring head is passed over the surface to create a predetermined score pattern including a series of perforations to facilitate separation of the media along such score pattern.

19. A printer system as in claim 18 which includes a single carriage for mounting both the printhead and the scoring head in side-by-side relationship.

20. A printer system as in claim 18 which includes a single carriage for mounting both the printhead and the scoring head in spaced apart positions in the media advance direction.

21. A printer system as in claim 18 wherein the image element is applied to the media during a first period of time to complete a portion of a printout, and the scoring pattern is created during a subsequent period of time to facilitate separation of the completed portion from the media.

22. A printer system as in claim 18 wherein the scoring pattern is created during a same period of time as the image element is applied to the media.

23. A apparatus comprising:

a carriage configured to move across a print surface;

a printing device carried by the carriage;

a scoring head coupled to the carriage, the scoring head including:

a member having a tip movable between a print surface engaging position and a print surface disengaged position; and an actuator configured to recipricatorily move the tip to the print surface engaging position a plurality of times forming a series of perforations.

24. The apparatus of claim 23, wherein the tip is resiliently biased towards one of the engaging position and the disengaged position.

25. The apparatus of claim 23, wherein the actuator includes one of an electromagnetic actuator, an electrostatic actuator or a piezo electric actuator.

26. The apparatus of claim 23 including a lubricant in contact with the member.

27. The of apparatus of claim 23 including a media support configured to absorb force from the tip when the tip is in the print surface engaging position, wherein the media support is configured to endure repeated impacts from the tip without serious functional deterioration.

28. The apparatus of claim 23, wherein the actuator is configured to recipricatorily drive the tip to the print surface engaging position a plurality of times so as to form overlapping penetrations.

29. The apparatus of claim 23, wherein the actuator is configured to recipricatorily drive the tip to the print surface engaging position a plurality of times to form lines of penetrations, wherein different lines have different spacings between adjacent penetrations.

* * * * *